US005707519A

United States Patent [19]

Miller et al.

[11] Patent Number: 5,707,519

[45] Date of Patent: Jan. 13, 1998

[54] CENTRIFUGAL OIL FILTER WITH PARTICLE RETENTION

[75] Inventors: Christopher O. Miller, East Peoria; J. W. Burrows, Brimfield, both of Ill.

[73] Assignee: Caterpillar Inc., Peoria, Ill.

[21] Appl. No.: 757,312

[22] Filed: Nov. 27, 1996

[51] Int. Cl.[6] ..... B04B 3/00; B04B 5/10; B04B 9/06

[52] U.S. Cl. ..... 210/354; 210/256; 210/360.1; 210/378; 210/505; 494/36; 494/49

[58] Field of Search ..... 494/36, 49, 24; 210/360.1, 378, 512.3, 354, 505, 256

[56] References Cited

U.S. PATENT DOCUMENTS

| | | | |
|---|---|---|---|
| 2,733,855 | 2/1956 | McCoy . | |
| 2,750,107 | 6/1956 | More . | |
| 3,432,091 | 3/1969 | Beazley . | |
| 4,046,315 | 9/1977 | Klingsenberg . | |
| 4,106,689 | 8/1978 | Kozulla . | |
| 4,165,032 | 8/1979 | Klingenberg . | |
| 4,221,323 | 9/1980 | Courtot . | |
| 4,400,167 | 8/1983 | Beazley . | |
| 5,149,424 | 9/1992 | Lundquist | 210/174 |
| 5,203,999 | 4/1993 | Hugues | 210/512.3 |

FOREIGN PATENT DOCUMENTS

| | | |
|---|---|---|
| 1532409 | 11/1978 | United Kingdom . |
| WO 19644 | 6/1996 | WIPO . |

OTHER PUBLICATIONS

Glacier Filters Sales Brochure, The Glacier Metal Co. Ltd., Somerset, TA19 9PH, England.

*Primary Examiner*—Thomas M. Lithgow
*Attorney, Agent, or Firm*—J. W. Burrows

[57] ABSTRACT

A centrifugal oil filter includes a housing having a rotatable bowl disposed in a first fluid chamber and rotatably disposed about a shaft extending through the first fluid chamber. The rotatable bowl has a flow directing member connected generally at the bottom thereof to define a particle collection basin and the flow directing member extends upwardly to form a passageway adjacent the shaft so that the fluid flow within the rotatable bowl is directed to a pair of nozzles which act to rotate the rotatable bowl responsive to fluid flow therethrough. A particle retention insert is made of a cellular structure and disposed in the particle collection basin. The particle retention insert functions to receive foreign particles within the cellular structure and retain them therein by protecting the particles from the fluid flow within the rotatable bowl.

5 Claims, 2 Drawing Sheets

CENTRIFUGAL OIL FILTER WITH PARTICLE RETENTION

TECHNICAL FIELD

This invention relates generally to a centrifugal oil filter and more particularly to a centrifugal oil filter that has foreign particle retention therein to retain the foreign particles that have been separated from the oil.

BACKGROUND ART

Centrifugal oil filters are well known and normally are used to separate particles from the oil by spinning a volume of oil at a high velocity to cause the foreign particles to be forced outwardly against the outer wall of the spinning member. Centrifugal oil filters have been used to separate soot and other very fine particles from the lube oil in engines. In this type of centrifugal oil filter, the soot cakes against the outer wall very tightly and does not have the tendency to separate from the wall and be carried downstream with the "cleaned" oil. When using centrifugal oil filters in oil systems that have other types of foreign particles, such as very fine dirt particles, metal particles, and/or other foreign particles that do not cake tightly together, it is necessary to maintain or flush away the foreign particles so that they do not get carried downstream with the "cleaned" oil. It has been known to provide a particle collection basin at the bottom of a filter to capture the foreign particles. These types of filters rely on gravity to move the foreign particles to the bottom. Many times, the foreign particles do not effectively settle to the bottom due to their size and/or density. Consequently, some of the foreign particles may be carried downstream with the cleaned oil. It is desirable to provide a centrifugal oil filter that is compact and effective to separate foreign particles from the oil and retain them so that they do not get carried away with the "cleaned" oil.

DISCLOSURE OF THE INVENTION

In one aspect of the present invention a centrifugal oil filter is provided for use in a fluid system having a source of fluid flow. The centrifugal oil filter includes a housing having a first fluid chamber defined therein, an inlet port, and an outlet port in fluid communication with the first fluid chamber. A shaft is disposed in the housing and extend through the first fluid chamber and defines a passage therein along a portion of its length with a transverse opening interconnecting the passage with the exterior of the shaft. The passage in the shaft is in open communication with the inlet port of the housing. A rotatable bowl has a bottom portion and is disposed in the first fluid chamber of the housing and operative to rotate about the shaft. The rotatable bowl has a second fluid chamber in fluid communication with the passage in the shaft, a pair of diametrically opposed nozzles disposed in the bottom portion of the rotatable bowl and operative to communicate fluid from the second fluid chamber to the first fluid chamber to force the rotatable bowl to rotate, and a flow directing member connected to the bottom portion of the rotatable bowl generally above the pair of nozzles to form a particle collection basin on the side of the flow directing member opposite the pair of nozzles. The flow directing member is spaced from the shaft to define a passageway to permit the fluid flow to pass therethrough to the pair of nozzles. The passageway is spaced upwardly from the point of connection of the flow directing member to the bottom portion. A particle retention insert is disposed in the particle collection basin in intimate contact with the flow directing member.

BEST MODE FOR CARRYING OUT THE INVENTION

Figure 1:
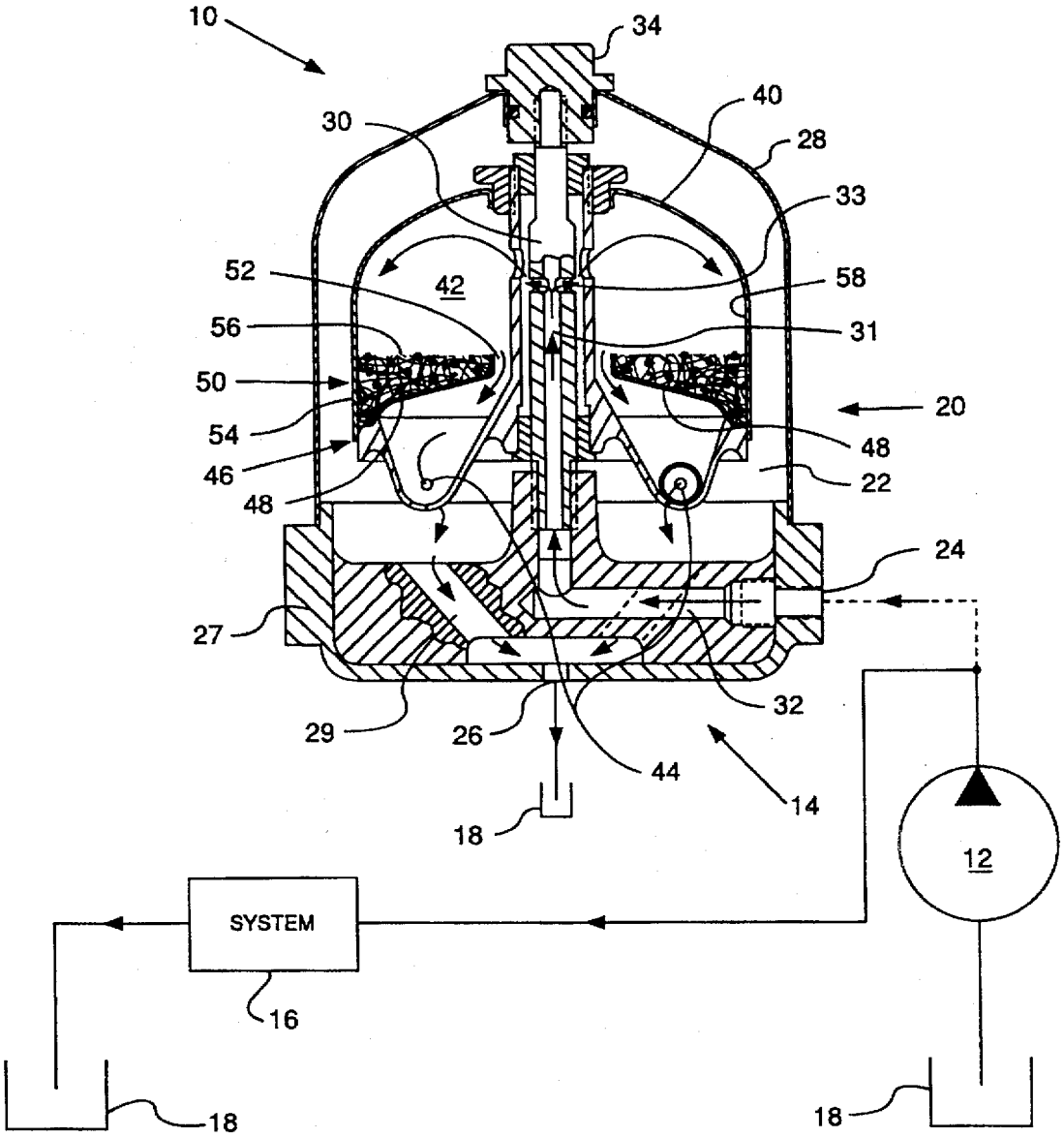
FIG. 1 is a schematic representation of a fluid system that diagrammatically illustrates a centrifugal oil filter incorporating an embodiment of the present invention.

Referring to FIG. 1 of the drawings, a fluid system 10 is illustrated and includes a source of fluid flow, such as a hydraulic pump 12, which directs fluid flow to a fluid circuit 16 and subsequently to a reservoir 18. A portion of the fluid flow from the hydraulic pump 12 is directed through a centrifugal oil filter 14 to the reservoir 18. It is recognized that the centrifugal oil filter 14 could be connected to the fluid system 10 at various locations without departing from the essence of the subject invention. It is also recognized that in systems having small flow rates, the pump could be connected directly to the inlet port 24 and the outlet port 26 could be connected to the fluid system 16.

The centrifugal oil filter 14 includes a housing 20 having a first fluid chamber 22 defined therein, an inlet port 24, and an outlet port 26 connected to the first fluid chamber 22. The housing 20 is formed by a base member 27 and a cover 28. The inlet port 24 and the outlet port 26 are both defined in the base member 27. A passage 29 connects the first fluid chamber 22 with the outlet port 26.

A shaft 30 is disposed in the housing 20 between the base member 27 and the cover 28 and extends through the first fluid chamber 22. The shaft 30 has a passage 31 in open communication with the inlet port 24 through a passage 32 and extends along a portion of its longitudinal length. A transverse opening 33 is defined in the shaft 30 and interconnects the passage 31 with the exterior of the shaft 30. A fastening device 34 is secured to the shaft 30 to secure the cover 28 to the base member 27.

A rotatable bowl 40 is disposed in the first fluid chamber 22 of the housing 20 and operative to rotate about the shaft 30. A second fluid chamber 42 is defined in the rotatable bowl 40 and is in fluid communication with the transverse opening 33. A pair of diametrically opposed nozzles 44 is defined in a bottom portion 46 of the rotatable bowl 40. The pair of diametrically opposed nozzles 44 is operative to cause the rotatable bowl to rotate about the shaft 30 in a well known manner by the reaction force of the fluid passing through the respective nozzles 44.

A flow directing member 48 is disposed in the second fluid chamber 42 and operative to direct the fluid flow within the upper portion of the second fluid chamber 42 to the pair of nozzles 44. The flow directing member 48 is connected to the bottom portion 46 and extends upwardly relative to the pair of nozzles 44 to form a particle collection basin 50. The flow directing member 48 is spaced from the shaft 30 to define a passageway 52.

A particle retention insert 54 is disposed in the particle collection basin 50 in intimate contact with the flow directing member 48. The particle retention insert 54 has an outer surface 56 that, in the subject embodiment, is generally even with the entrance of the passageway 50. The particle retention insert 54 is a cellular structure. The cellular structure could be formed by metal fibers interconnected together, a synthetic media having various openings and passages or any other material having a cellular structure of openings and passages that is capable of permitting fluid flow to enter and leave the material through various paths at a low velocity.

Figure 2:
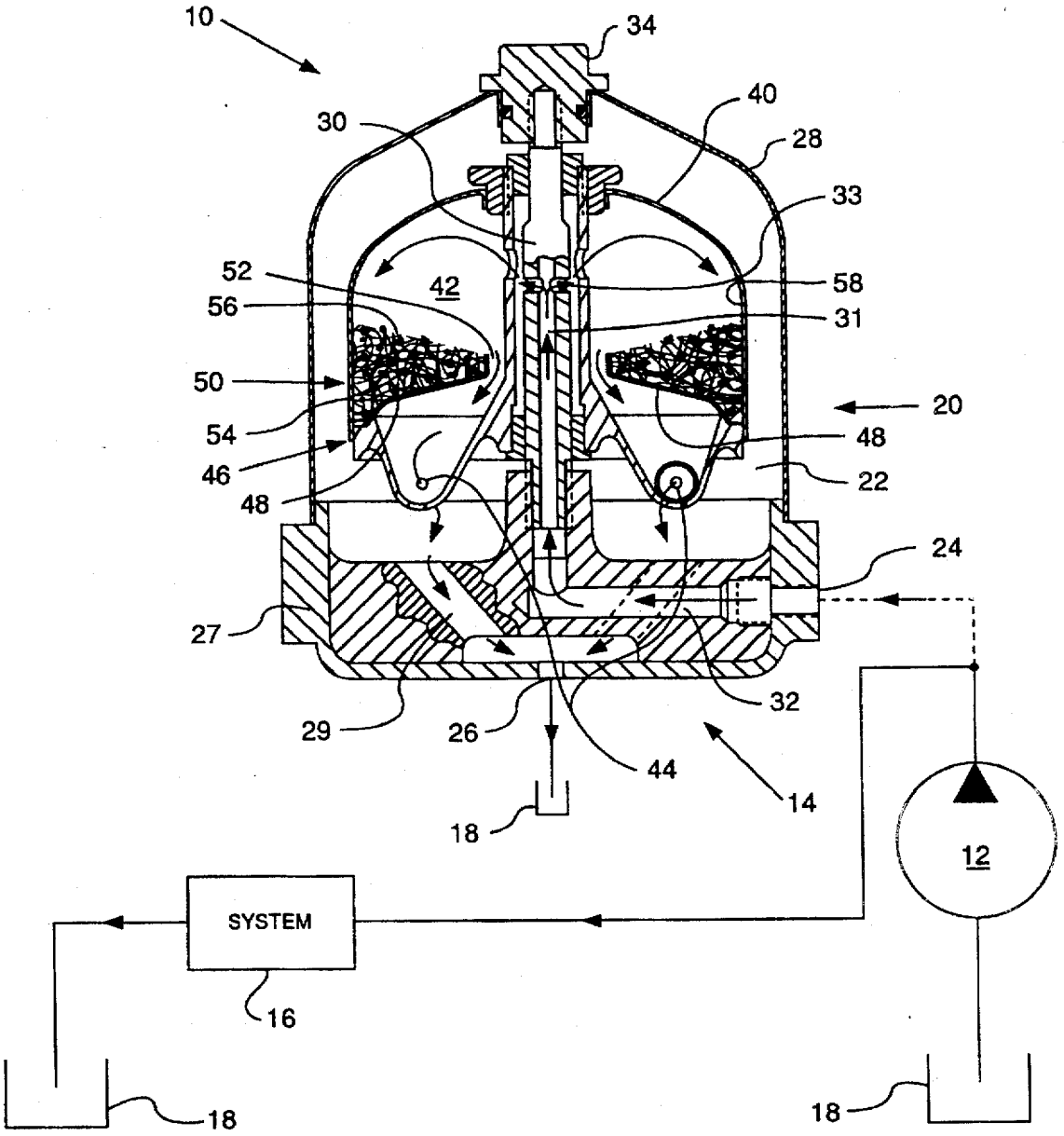
FIG. 2 is a diagrammatic representation of the centrifugal oil filter incorporating another embodiment of the subject invention.

Referring to FIG. 2, another embodiment of the subject invention is disclosed. Like elements have like element numbers. The only difference between the embodiment of FIG. 2 relative to the embodiment of FIG. 1 is the shape of the particle retention insert 54. The particle retention insert 54 of FIG. 2 has an outer surface that extends upwardly from the entrance of the passageway 50 to an outer wall 58 of the rotatable bowl 40.

It is recognized that various form of the subject centrifugal oil filter 14 could be utilized without departing from the essence of the subject invention. For example, additional nozzles 44 could be added to increase the rotational forces applied to the rotatable bowl 40. The shape of the particle retention insert 54 and/or the particle collection basin 50 could be varied from those disclosed herein.

Industrial Applicability

During operation, a portion of the fluid flows from the pump 12 into the second fluid chamber 42 of the centrifugal through the inlet port 24, the passage 31, the transverse opening 33. The fluid flows through the passageway 50 and out the pair of nozzles 44 into the first fluid chamber 22 and out the outlet port 26 to the reservoir 18.

The reaction force of the fluid flowing through the pair of nozzles 44 causes the rotatable bowl 40 to rotate about the shaft 30. Due to the rate of fluid flow across the pair of nozzles 44, the rotatable bowl 40 rotates at a high velocity. During the high rate of rotation of the rotatable bowl 44, foreign particles are forced outwardly to the outer wall 58 of the rotatable bowl 40. Due to the weight of the various foreign particles, some of them will fall to the bottom due to gravity. These foreign particles enter the cellular structure of the particle retention insert 54. Any of the foreign particles that do not fall, during use will remain against the outer wall 58 until the flow through the centrifugal oil filter is substantially reduced or stopped. In this event, the remaining foreign particles settles to the bottom and enters the cellular structure of the particle retention insert 54. Since the foreign particles are held in or protected by the cellular structure of the particle retention insert 54 and the particle retention insert 54 is generally below the entrance to the passageway 52, starting the fluid flow through the centrifugal oil filter 14 does not tend to pick up any of the foreign particles that are within the cellular structure and carry them downstream with the cleaned oil. The above is based on the principle that fluid flow takes the path of least resistance. Consequently, the fluid will not have the tendency to flow through the cellular structure of the particle retention insert 54 and flush out the foreign particles.

From a review of the above, it should be apparent that the centrifugal oil filter 14 of the subject invention is effective to separate foreign particles from the oil and retain them within the particle retention insert 54. By having the particle retention insert 54 disposed within the rotatable bowl 40, the centrifugal oil filter 14 is more compact in size.

Other aspects, objects and advantages of the invention can be obtained from a study of the drawings, the disclosure and the appended claims.

What is claimed is:

1. A centrifugal oil filter adapted for use in a fluid system having a source of fluid flow, comprising:

a housing defining a first fluid chamber, an inlet port, and an outlet port in fluid communication with the first fluid chamber;

a shaft disposed in the housing and extends through the first fluid chamber, a passage is defined in the shaft along a portion of its length and in open communication with the inlet port, and a transverse opening is defined in the shaft to interconnect the passage with the exterior of the shaft;

a rotatable bowl having a bottom portion and disposed in the first fluid chamber of the housing and operative to rotate about the hollow shaft, the rotatable bowl defining a second fluid chamber in fluid communication with transverse opening in the shaft, a pair of diametrically opposed nozzles disposed in the bottom portion of the rotatable bowl and operative to communicate fluid from the second fluid chamber to the first fluid chamber to force the rotatable bowl to rotate, and a flow directing member connected to the bottom portion of the rotatable bowl generally above the pair of nozzles to form a particle collection basin on the side of the flow directing member opposite the pair of nozzles, the flow directing member extending radially inward to a position which is spaced from the shaft to define a substantially unobstructed passageway therebetween so that the substantially unobstructed passageway allows substantially unobstructed fluid commuication between the portion of the second chamber above the flow directing member, and the pair of nozzles generally below the flow directing member, said substantially unobstructed passageway being spaced upwardly from the point of connection of the flow directing member to the bottom portion; and a particle retention insert disposed in the particle collection basin in intimate contact with the flow directing member and spaced from the shaft.

2. The centrifugal oil filter of claim 1 wherein the particle retention insert is composed of a cellular structure.

3. The centrifugal oil filter of claim 2 wherein the particle retention insert is composed of metal fibers interconnected together.

4. The centrifugal oil filter of claim 2 wherein the particle retention insert is made from a synthetic media having a cellular structure.

5. The centrifugal oil filter of claim 2 wherein the rotatable bowl has an outer wall and the particle retention insert has an upper surface that is angled upwardly from the passageway to the outer wall of the rotatable bowl.

* * * * *